US012708837B2

(12) United States Patent
Garcia, Jr.

(10) Patent No.: US 12,708,837 B2
(45) Date of Patent: Aug. 18, 2026

(54) TRIPLE POKER CARD TABLE AND METHOD FOR PLAYING NEW FIVE-CARD DRAW GAME USING THE CARD TABLE THEREOF

(71) Applicant: Tommy Garcia, Jr., Sacramento, CA (US)

(72) Inventor: Tommy Garcia, Jr., Sacramento, CA (US)

( * ) Notice: Subject to any disclaimer, the term of this patent is extended or adjusted under 35 U.S.C. 154(b) by 501 days.

(21) Appl. No.: 18/347,645

(22) Filed: Jul. 6, 2023

(65) Prior Publication Data

US 2024/0367027 A1 Nov. 7, 2024

Related U.S. Application Data

(63) Continuation-in-part of application No. 18/143,827, filed on May 5, 2023.

(51) Int. Cl.
*A63F 1/06* (2006.01)
*A63F 1/00* (2006.01)

(52) U.S. Cl.
CPC ..... *A63F 1/067* (2013.01); *A63F 2001/005* (2013.01)

(58) Field of Classification Search
CPC ..... A63F 2001/005; A63F 2001/027; A63F 1/02; A63F 1/00; A63F 3/00157; A63F 2003/00164
See application file for complete search history.

(56) References Cited

U.S. PATENT DOCUMENTS

| | | | | | |
|---|---|---|---|---|---|
| 681,925 | A | * | 9/1901 | O'Neill | A63F 1/02 273/304 |
| 712,566 | A | * | 11/1902 | Muller | A63F 1/02 273/304 |
| 821,781 | A | * | 5/1906 | Cadwallader | A63F 1/02 273/304 |
| 1,551,761 | A | * | 9/1925 | Mccarroll | A63F 1/02 273/304 |
| 1,568,206 | A | * | 1/1926 | Brandt | A63F 1/02 273/296 |
| 1,693,525 | A | * | 11/1928 | Niederlitz | A63F 1/02 273/304 |
| D118,977 | S | * | 2/1940 | Kermode | 273/299 |
| D123,429 | S | * | 11/1940 | Dickman | 273/304 |
| D169,847 | S | * | 6/1953 | Inman | 273/304 |
| D212,239 | S | * | 9/1968 | Schick | 273/304 |
| D222,490 | S | * | 10/1971 | Alaska | 273/293 |

(Continued)

*Primary Examiner* — Christine M Mills

(57) ABSTRACT

A Triple Poker card table, which can let players use at least one deck of special designed playing card to play a new Five-Card Draw game and can bet up to 6 bets at a time, comprising: a table structure, with a surface that has a plurality of player areas, and each of the player area is provided with a first bet location, a second bet location, and a third bet location, these bet locations are arranged vertically, and a split location is adjacent to the first bet location, the first bet location and the split location are arranged horizontally; and two table legs, which are set under the table structure. The Triple Poker card table is designed to accommodate the special designed playing cards. These cards cannot be used on any other card table, and this card table also cannot be used with other standard playing cards.

12 Claims, 7 Drawing Sheets

(56) References Cited

U.S. PATENT DOCUMENTS

| | | | | | |
|---|---|---|---|---|---|
| 4,170,358 | A * | 10/1979 | Hancock | A63F 1/02 | 273/306 |
| D264,734 | S * | 6/1982 | Nugroho | 273/304 | |
| 4,588,193 | A * | 5/1986 | Winston | A63F 1/02 | 273/306 |
| 5,280,916 | A * | 1/1994 | Gleason, Jr. | A63F 1/02 | 273/307 |
| 5,445,391 | A * | 8/1995 | Gleason, Jr. | A63F 1/02 | 273/304 |
| 5,718,432 | A * | 2/1998 | Fraser | A63F 1/02 | 273/304 |
| 5,895,048 | A * | 4/1999 | Smith, Jr. | A63F 1/02 | 273/293 |
| 6,726,427 | B2 * | 4/2004 | Jarvis | A63F 3/00157 | 273/292 |
| 7,156,398 | B1 * | 1/2007 | Phillips | A63F 1/02 | 273/293 |
| 7,481,435 | B2 * | 1/2009 | Shetterly | A63F 1/02 | 273/306 |
| 9,569,935 | B2 * | 2/2017 | Berman | G07F 17/3293 | |
| 10,086,258 | B2 * | 10/2018 | Prucey | G07F 17/3293 | |
| 2008/0197572 | A1 * | 8/2008 | Feola | A63F 3/00157 | 273/292 |
| 2012/0015703 | A1 * | 1/2012 | Berman | G07F 17/3211 | 463/43 |
| 2014/0370953 | A1 * | 12/2014 | Singh | G07F 17/326 | 463/13 |
| 2022/0266122 | A1 * | 8/2022 | Garcia, Jr. | A63F 1/067 | |

* cited by examiner

TRIPLE POKER CARD TABLE AND METHOD FOR PLAYING NEW FIVE-CARD DRAW GAME USING THE CARD TABLE THEREOF

CROSS-REFERENCE TO RELATED APPLICATIONS

This application is a continuation-in-part of application Ser. No. 18/143,827, filed on May 5, 2024.

FIELD OF THE INVENTION

The invention relates generally to the field of casino gaming. More particularly, the invention pertains to a new method of playing Five-Card Draw by using a newly designed Triple Poker card table. The invention further relates to a card table which can let players using at least one deck of special designed playing card, which is designed for playing games called Triple Texas Holdem or Triple Poker, to play a new Five-Card Draw game (called Triple Poker) and can bet up to 3 to 6 bets at a time in one hand of cards because the special designed playing card just like combined three decks of cards into one deck of cards. The top row consisting of one deck of 52 cards, the middle row consisting of another deck of 52 cards, and the bottom row consisting of the other deck of 52 cards.

BACKGROUND OF THE INVENTION

Five-Card Draw is one of well-known card games, which sometimes is played by multiple players for fun, or sometimes for gambling and wagering in a verified entertainment place, like a casino, where usually there are standard card tables, dealers, applied to some special rules. In Five-Card Draw card game, players usually use one or more sets of standard 52-card deck of cards, each of them has a combination of one of four suits and one of 13 ranks thereon.

In order to increase interest and fun in the game, people have developed variations to Five-Card Draw card games. While various games have been proposed to increase interest and fun in a game or to create a new variant game to generate interest, the vast majority of them are limited to the modification of Five-Card Draw rules or bet rules. A brand-new Five-Card Draw game based on a variation of card deck design and card table thereof is not invented to boost the interest and fun for playing.

Thus, there has been a desire to provide a present Five-Card Draw game with simple and interesting variations to both create additional interest as well as increase wagering possibilities.

SUMMARY OF THE INVENTION

The present invention is proposed to address at least some of the foregoing disadvantages where multiple players are suffering from playing a traditional Five-Card Draw card game without change, consequently bringing about interest and wagering opportunities for each player exponentially.

One of the objectives of the present invention is to provide a method for playing a new Five-Card Draw game, allowing players to increase the playing rules and betting opportunities during one hand in Five-Card Draw game.

Another objective of the present invention is to provide a novel card deck (Triple Poker) with special patterns on suits and ranks (or letters & numbers), especially with a layout of multiple rows for a combination thereof, being played in an exclusive designed table.

Another objective of the present invention is to provide a specialized card table for the present card game, being applied to exclusive Triple Poker card game.

In one embodiment, the present invention provides a Triple Poker card table, which can let players using at least one deck of special designed playing card to play a new Five-Card Draw game and can bet up to 3~6 bets at a time, wherein each of the special designed playing card contains a first row, a second row, and a third row vertically arranged from the top to the bottom on the surface of the special designed playing card, and the first row contains three same numbers or letters with the same suit, the second row contains three same numbers or letters with the same suit, the third row contains three same numbers or letters with the same suit, and the numbers or letters between each row are different, the Triple Poker card table comprising:

a table structure, with a surface that has a plurality of player areas and three community card slots, and each of the player area is provided with a first bet location, a second bet location, and a third bet location, these bet locations are arranged vertically, and the first bet location corresponds to the first row on the surface of the special designed playing cards, the second bet location corresponds to the second row on the surface of the special designed playing cards, and the third bet location corresponds to the third row on the surface of the special designed playing cards, and there are a first split location, a second split location, and a third split location that are adjacent to the first bet location, the second bet location, and the third bet location respectively; and two table legs, which are set under the table structure.

Another aspect in the embodiment, the bottom surface of the table structure is provided with two holes, and one end of each of the table leg is correspondingly provided with a convex part, so that the convex parts are inserted into the holes to fix the table legs to the table structure.

Another aspect in the embodiment, the depth of the holes is 3 and ⅛ inches, and the distance between the holes and the nearest end cap is also 3 and ⅛ inches.

Another aspect in the embodiment, the bottom surface of the table structure is provided with a convex column, and the convex column is horizontally arranged at the middle section of the bottom surface of the table structure, and the holes are arranged on the convex column.

Another aspect in the embodiment, the first row, the second row, or the third row on at least one of the special designed playing cards contains letters of "WILD", and "WILD" represent any number, letter, and suit that a player or a dealer could build for the best possible hand.

Another aspect in the embodiment, the suit of the first row, the second row, and the third row are all different.

In another embodiment, the present invention provides a method for playing a new Five-Card Draw game between at least one player and a dealer using at least one deck of special designed playing cards on the Triple Poker card table of claim 1, wherein each of the special designed playing card contains a first row, a second row, and a third row vertically arranged from the top to the bottom on the surface of the special designed playing card, and the first row contains three same numbers or letters with the same suit, the second row contains three same numbers or letters with the same suit, the third row contains three same numbers or letters with the same suit, and the numbers or letters between each row are different, the method comprising steps of:

A) having at least one player place at least one wager to participate in the new Five-Card Draw game, wherein the at least one wager can be put on any one or two or all three of the first bet location, the second bet location, and the third bet location;

B) dealing five special designed playing cards to each of the at least one player facing up in a clockwise manner;

C) dealing five special designed playing cards to a dealer with two first special designed playing cards facing up, and three second special designed playing cards facing down;

D) waiting for each of the at least one player to decide whether to place another wager or fold on any one or two or all three of the first bet location, the second bet location, and the third bet location, then;

a) if the at least one player decides to fold on any one or two of the first bet location, the second bet location, and the third bet location, the dealer takes the wager placed on the corresponding bet location, and move to next step;

b) if the at least one player decides to fold on all three of the first bet location, the second bet location, and the third bet location, the dealer takes the wager placed on the corresponding bet locations, and the game is over; or c) if the at least one player decides to place another wager on any one or two or all three of the first bet location, the second bet location, and the third bet location, the game moves to next step;

E) dealing one community card using the special designed playing cards facing up in the community card slots;

F) repeating step (D) and corresponding sub-steps;

G) dealing one more community card using the special designed playing cards facing up in the remaining community card slots;

H) repeating step (D) and the corresponding sub-steps;

I) dealing a last community card using the special designed playing cards facing up in a last remaining community card slots;

J) repeating step (D) and the corresponding sub-steps;

K) revealing the second special designed playing cards in the dealer's hand, and determining which row combining the community cards forms a best possible hand and use that row to compete with the at least one player's best possible hand for each row that has put the at least one wager on the corresponding bet location; and L) completing the new Five-Card Draw game according to conventional rules of play.

One aspect in the embodiment, the first row, the second row, or the third row on at least one of the special designed playing cards contains letters of "WILD", and "WILD" represent any number, letter, and suit that the at least one player or the dealer could build for the best possible hand.

Another aspect in the embodiment, the suit of the first row, the second row, and the third row are all different.

In another embodiment, the invention provides a method for playing a new Five-Card Draw game between at least one player and a dealer using at least one deck of special designed playing cards on the Triple Poker card table of claim 1, wherein each of the special designed playing card contains a first row, a second row, and a third row vertically arranged from the top to the bottom on the surface of the special designed playing card, and the first row contains three same numbers or letters with the same suit, the second row contains three same numbers or letters with the same suit, the third row contains three same numbers or letters with the same suit, and the numbers or letters between each row are different, the method comprising steps of:

A) having at least one player place at least one wager to participate in the new Five-Card Draw game, wherein the at least one wager can be put on any one or two or all three of the first bet location, the second bet location, and the third bet location;

B) dealing five special designed playing cards to each of the at least one player facing up in a clockwise manner;

C) dealing five special designed playing cards to a dealer with two first special designed playing cards facing up, and three second special designed playing cards facing down, then;

i) if the numbers or letters in any row of first two special designed playing cards dealt to the at least one player's hand are the same, the at least one player can split the first two special designed playing cards and put at least one wager the first split location, the second split location, and/or the third split location based on the at least one player's decision, then deal eight additional special designed playing cards to the at least one player to make the first two special designed playing cards form a five-card hand respectively after split;

D) waiting for each of the at least one player to decide whether to place another wager or fold on any of the first bet location, the second bet location, the third bet location, the first split location, the second split location, and/or the third split location, then;

a) if the at least one player decides to fold on any of the first bet location, the second bet location, the third bet location, the first split location, the second split location, and/or the third split location, the dealer takes the wager placed on the corresponding bet location and/or the corresponding split location, and move to next step;

b) if the at least one player decides to fold on all of the first bet location, the second bet location, the third bet location, the first split location, the second split location, and the third split location, the dealer takes all the wager placed on the corresponding bet locations and the corresponding split location, and the game is over; or c) if the at least one player decides to place another wager on any of the first bet location, the second bet location, the third bet location, the first split location, the second split location, and/or the third split location, the game moves to next step;

E) dealing one community card using the special designed playing cards facing up in the community card slots;

F) repeating step (D) and corresponding sub-steps;

G) dealing one more community card using the special designed playing cards facing up in the remaining community card slots;

H) repeating step (D) and the corresponding sub-steps;

I) dealing a last community card using the special designed playing cards facing up in a last remaining community card slots;

J) repeating step (D) and the corresponding sub-steps;

K) revealing the second special designed playing cards in the dealer's hand, and determining which row combining the community cards forms a best possible hand and use that row to compete with the at least one player's best possible hand for each row that has put the at least one wager on the corresponding bet location; and L) completing the new Five-Card Draw game according to conventional rules of play.

Another aspect in the embodiment, the first row, the second row, or the third row on at least one of the special designed playing cards contains letters of "WILD", and "WILD" represent any number, letter, and suit that the at least one player or the dealer could build for the best possible hand.

Another aspect in the embodiment, the suit of the first row, the second row, and the third row are all different.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
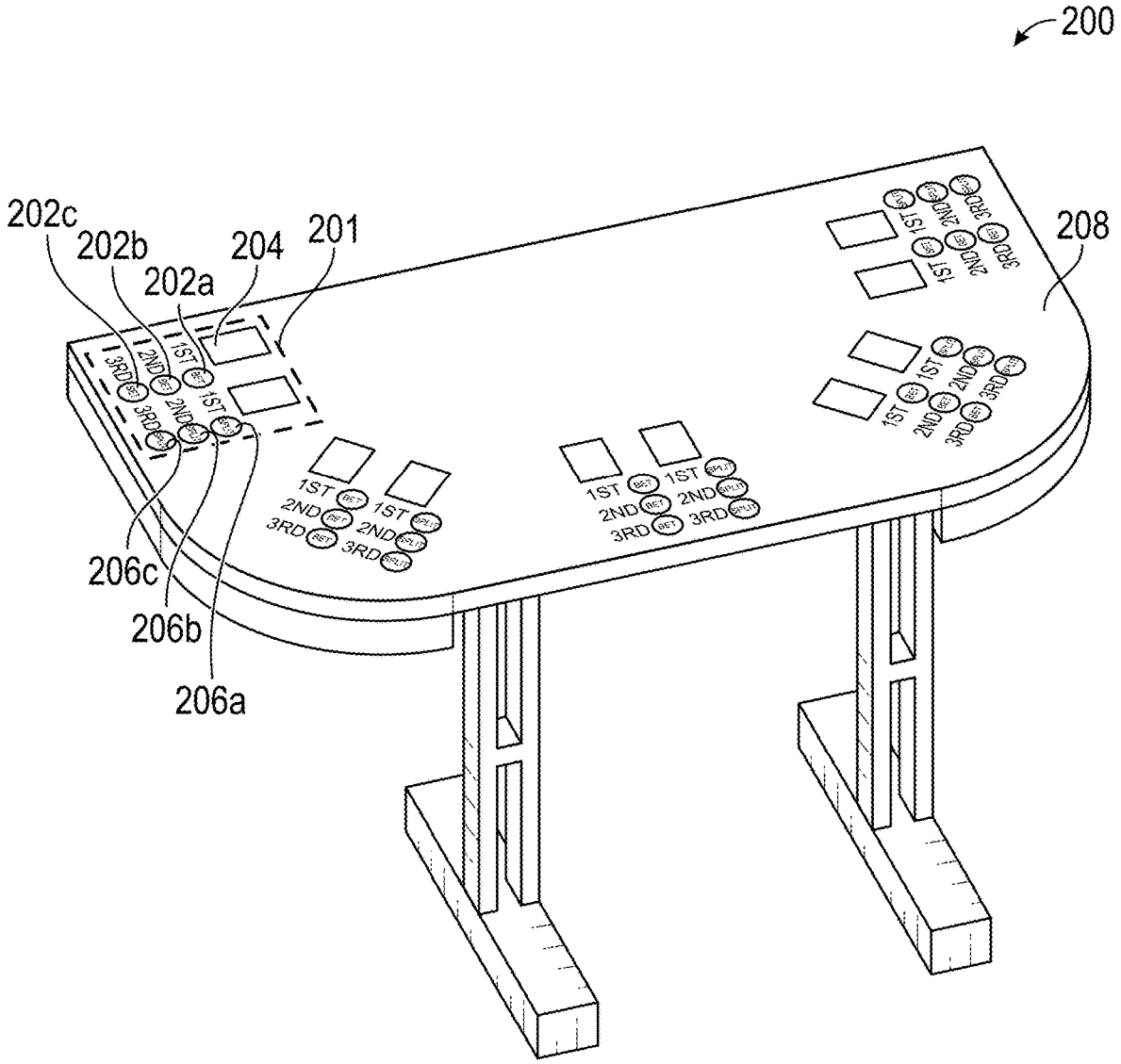
FIG. 1 illustrates a perspective view of a Triple Poker card table, in accordance with an embodiment of the present invention.
Figure 2:
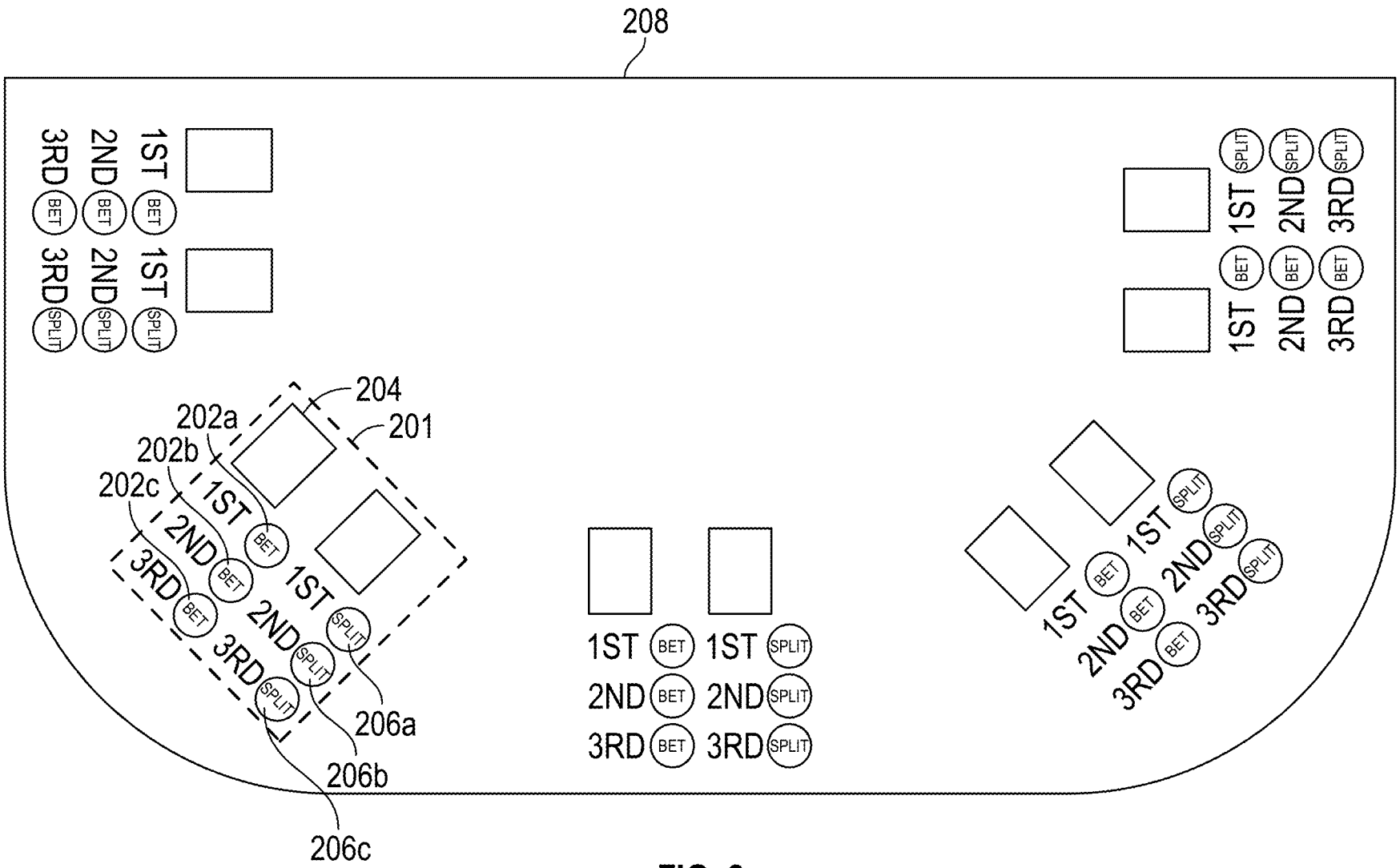
FIG. 2 illustrates a schematic diagram of one side of surface of the desktop, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

In one embodiment of the present invention presented in FIGS. 1-5, this invention provides a Triple Poker card table 200, which can let players using at least one deck of special designed playing card to play a new Five-Card Draw game and can bet up to 3~6 bets at a time, wherein each of the special designed playing card contains a first row 602*a*, a second row 602*b*, and a third row 602*c* vertically arranged from the top to the bottom on the surface of the special designed playing card, and the first row 602*a* contains three same numbers or letters with the same suit, the second row 602*b* contains three same numbers or letters with the same suit, the third row 602*c* contains three same numbers or letters with the same suit, and the numbers or letters between each row are different, the Triple Poker card table 200 comprising:

a table structure 200, with a surface 208 that has a plurality of player areas 201 and three community card slots 203, and each of the player area 201 is provided with a first bet location 202*a*, a second bet location 202*b*, and a third bet location 202*c*, these bet locations are arranged vertically, and the first bet location 202*a* corresponds to the first row 602*a* on the surface of the special designed playing cards, the second bet location 202*b* corresponds to the second row 602*b* on the surface of the special designed playing cards, and the third bet location 202*c* corresponds to the third row 602*c* on the surface of the special designed playing cards, and there are a first split location 206*a*, a second split location 206*b*, and a third split location 206*c* that are adjacent to the first bet location 202*a*, the second bet location 202*b*, and the third bet location 202*c* respectively; and two table legs 406, which are set under the table structure 200.

Through the aforementioned Triple Poker card table 200, players can play a new game of Triple Poker with the special designed playing cards on it. The most special feature is that players can bet 3~6 bets at a time in one hand (or two hands) of cards in the same game, that is, they can be placed wager(s) on the first bet location 202*a*, the second bet location 202*b*, the third bet location 202*c*, and/or the first split location 206*a*, the second split location 206*b*, the third split location 206*c* (if split) of the desktop, which means betting on the best possible hand of the first row 602*a*, the second row 602*b*, and/or the third row 602*c* shown on the special designed playing cards respectively, while the traditional Five-Card Draw can only bet 1 bet. In some embodiments, there are player card slots 204 located in each of the player area to put the special designed playing cards. This special design makes the game more interesting and then proves there is a particularity in the Triple Poker card table, like shown in FIG. 4.

Figure 3:
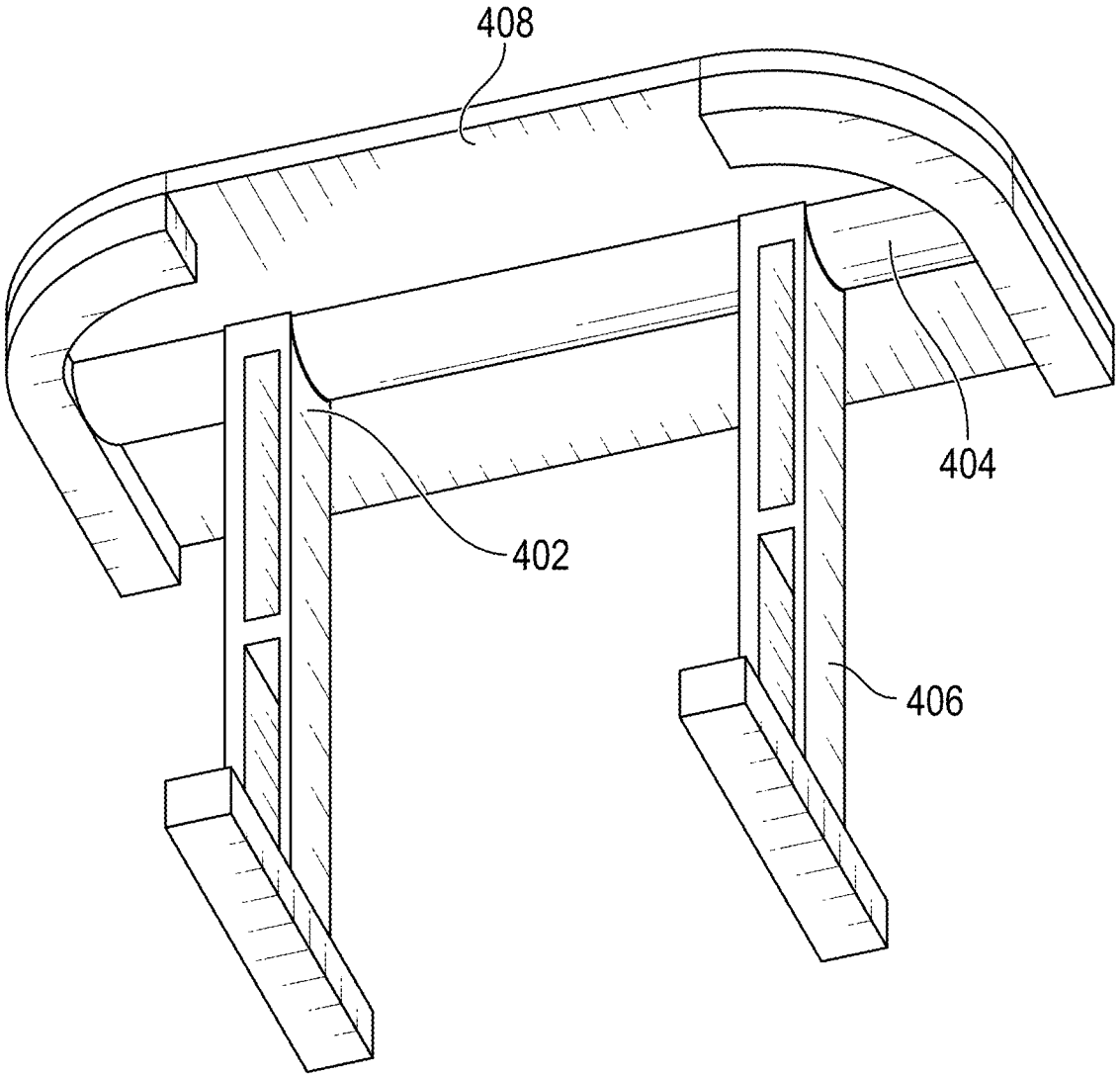
FIG. 3 illustrates a perspective view of the bottom surface of the table structure and the table legs, in accordance with an embodiment of the present invention.
Figure 4:
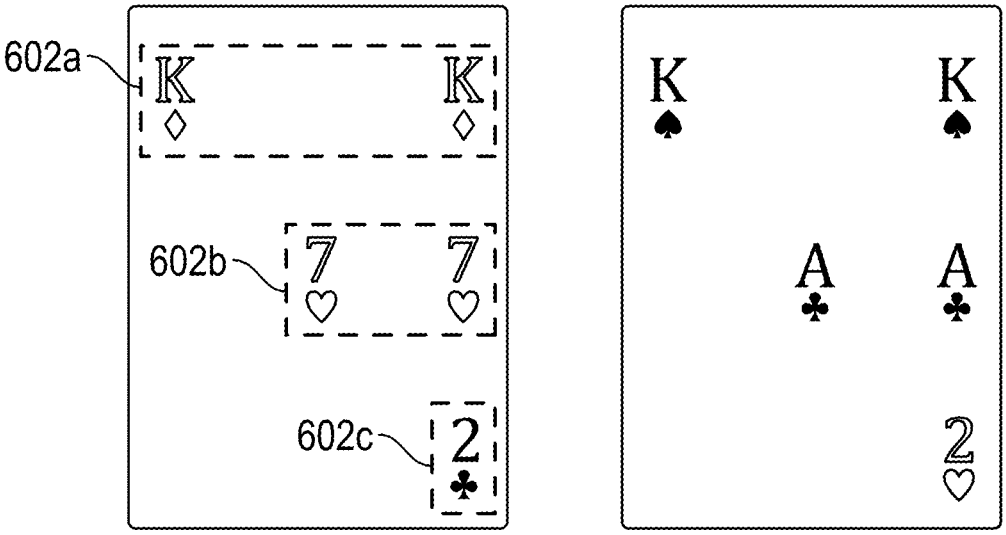
FIG. 4 illustrates a plan view showing the card surface of the special designed playing card, in accordance with an embodiment of the present invention.
Figure 5:
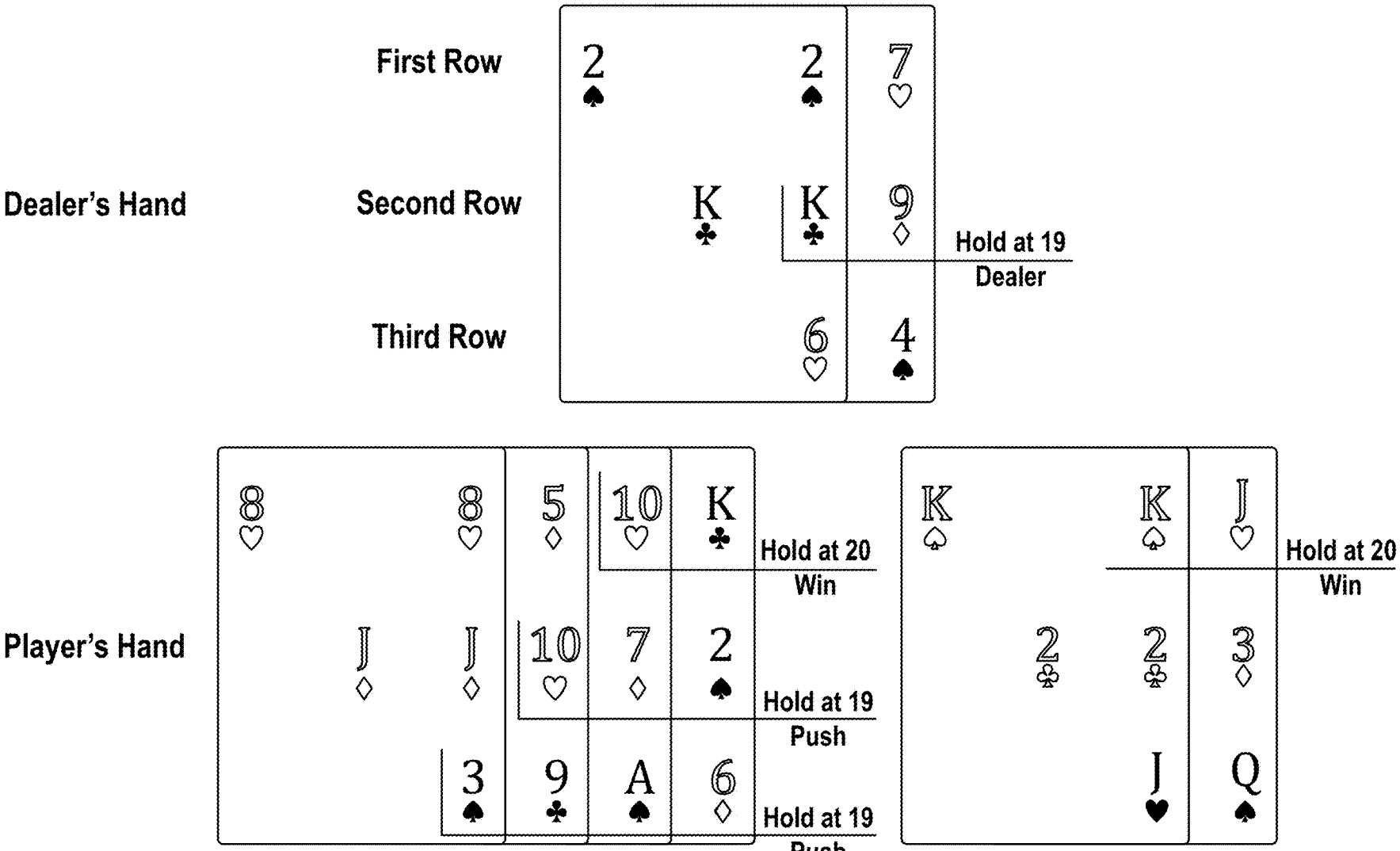
FIG. 5 illustrates a plan view showing the card surface of the special designed playing cards, how each card should read in each line, and how to determine a winning or losing hand for the first bet, second bet, third bet, first split, second split, third split, compared to the dealer's hand, furthermore, they display how three decks of cards can be combined in one deck of cards, in accordance with an embodiment of the present invention.

In another aspect, please also refer to FIG. 3, the bottom surface of the table structure is provided with a convex column 404, and the convex column 404 is horizontally arranged at the middle section of the bottom surface 408 of the table structure, and two holes 402 are arranged on the convex column 404, and one end of each of the table leg 406 is correspondingly provided with a convex part, so that the convex parts are inserted into the holes 402 to fix the table legs 406 to the table structure. Such an arrangement allows the Triple Poker card table 200 to be easily decomposed into the table structure and the table legs 406, so as to reduce the space required for storage and further enhance the practicability of the present invention.

In another aspect, for the table size in an embodiment, preferably, the depth of the holes is 3 and ⅛ inches. The overall standing height of the Triple Poker card table 200 is approximately 3 feet 3 inches and the overall size of the Triple Poker card table 200 is approximately 4 feet 1 15/16 inches long and 2 feet 1¼ inches wide. Each of the table legs is 3 feet 2 5/16 inches at length. All the above sizes for the table 200 should be adjustable to allow a comfortability to an adult player, sitting on the table.

In one embodiment of the present invention, the first row 602*a*, the second row 602*b*, or the third row 602*c* on at least one of the special designed playing cards contains letters of "WILD" 603, and "WILD" 603 represent any number, letter, and suit that a player or a dealer could build for the best possible hand. Just like the example illustrating in the FIG. 4, these special designed playing cards allow each player to have additional interesting feature by using "WILD" 603 to make the game much more unpredictable. Furthermore, the suits of the first row 602*a*, the second row 602*b*, and the third row 602*c* are all arranged differently. That will not only be interesting, but also make it difficult for people who count cards, because there are three decks of cards combined into one deck of cards for 156 cards, which means the first rows 602*a* of the total special designed playing cards will contain all the numbers, letters and suits in the original 52 cards, the second rows 602*b* of the total special designed playing cards will also contain all the numbers, letters and suits in the original 52 cards, and the third rows 602*c* will do the same to make three decks of cards combined into one deck of cards of the special designed playing cards. Also, it makes it less difficult for players to confuse the numbers or letters on each row of each special designed playing card. Furthermore, the special designed playing cards are a copyright product filed by the inventor, which can also reveal its uniqueness and originality.

Figure 6:
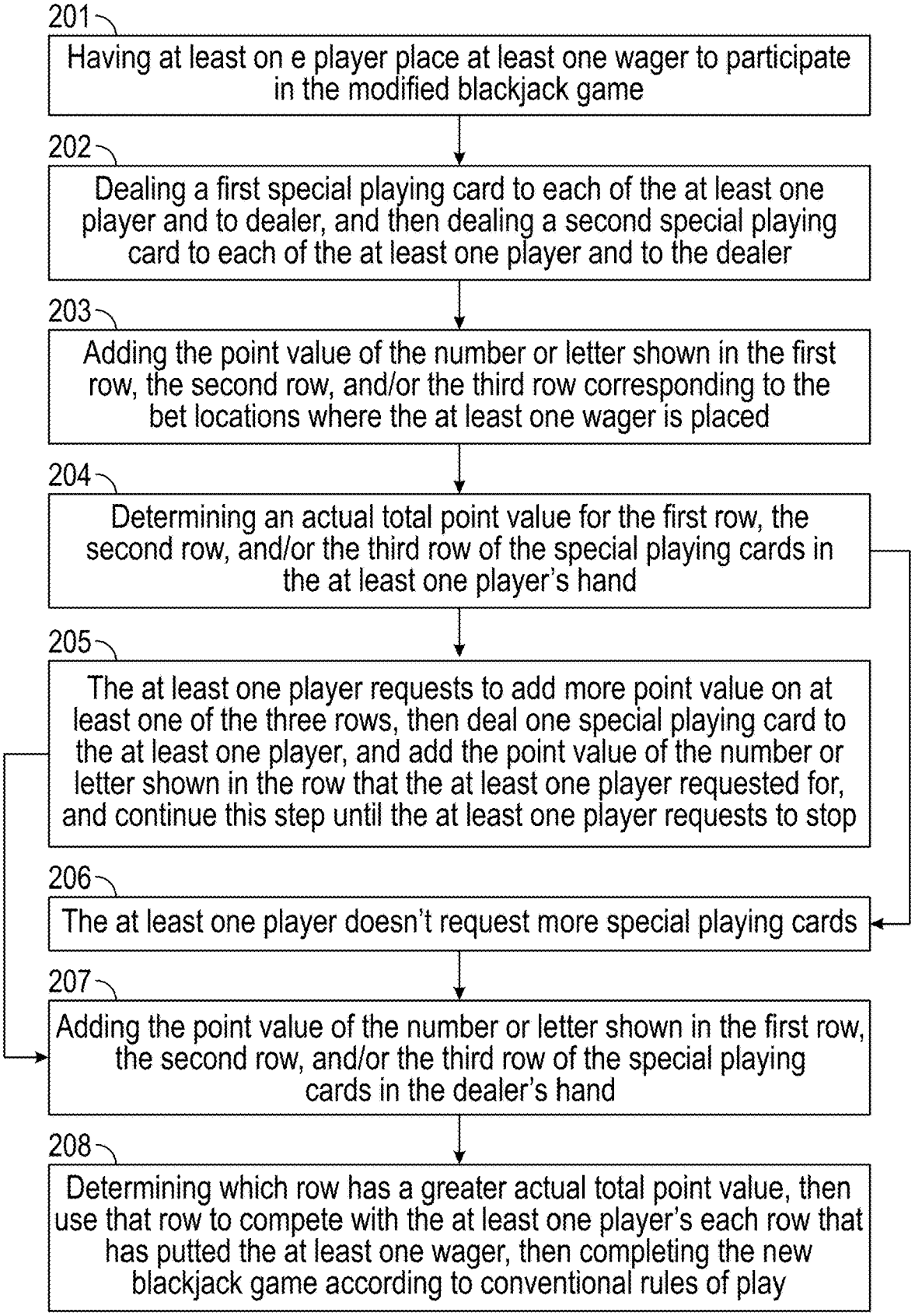
FIG. 6 illustrates the steps of playing method in the first embodiment, in accordance with an embodiment of the present invention.

In another aspect, this invention also discloses a method for playing a new Five-Card Draw game between at least one player and a dealer using at least one deck of special designed playing cards on the Triple Poker card table, like illustrating in the FIG. 6, wherein each of the special designed playing cards contains a first row 602*a*, a second row 602*b*, and a third row 602*c* vertically arranged from the top to the bottom on the surface of the special designed playing card, and the first row 602*a* contains three same numbers or letters with the same suit, the second row 602*b* contains three same numbers or letters with the same suit, the third row 602*c* contains three same numbers or letters with the same suit, and the numbers or letters between each row are different, the method comprising the steps listed below.

Step S201: Having at least one player place at least one wager to participate in the new Five-Card Draw game, wherein the at least one wager can be put on any one or two or all three of the first bet location, the second bet location, and the third bet location. In this method, the difference can be seen between the prior art and this invention because the normal Five-Card Draw game can only place at least one wager for one card (hand), but this invention can allow player(s) to bet on up to three to six hands at once, which makes this new Five-Card Draw game more exciting and fun by using the special designed playing cards.

Step S202: Dealing five special designed playing cards to each of the at least one player facing up in a clockwise manner, and dealing five special designed playing cards to a dealer with two first special designed playing cards facing up, and three second special designed playing cards facing down.

Step S203: Waiting for each of the at least one player to decide whether to place another wager or fold on any one or two or all three of the first bet location, the second bet location, and the third bet location, then continue based on the sub-steps listed below:

a) if the at least one player decides to fold on any one or two of the first bet location, the second bet location, and the third bet location, the dealer takes the wager placed on the corresponding bet location, and move to next step;

b) if the at least one player decides to fold on all three of the first bet location, the second bet location, and the third bet location, the dealer takes the wager placed on the corresponding bet locations, and the game is over; or c) if the at least one player decides to place another wager on any one or two or all three of the first bet location, the second bet location, and the third bet location, the game moves to next step. If the at least one player decides not to put any additional wager and pass, the game will also move to next step.

Step S204: Dealing one community cards using the special designed playing cards facing up in the community card slots.

Step S205: Repeating step S203 and the corresponding sub-steps. In this step, the dealer will wait for all player to decide their move.

Step S206: Dealing one more community card using the special designed playing cards facing up in the remaining community card slots.

Step S207: Repeating step S203 and the corresponding sub-steps again. In this step, the dealer will wait for all player to decide their move again.

Step S208: Dealing a last community card using the special designed playing cards facing up in the last remaining community card slots.

Step S209: Repeating step S203 and the corresponding sub-steps one last time. In this step, the dealer will wait for all player to decide their move.

Step S210: Revealing the three second special designed playing cards in the dealer's hand, and determining which row combining the community cards could form a best possible hand and use that row to compete with the at least one player's best possible hand for each row that has put the at least one wager on the corresponding bet location.

Step S211: Completing the new Five-Card Draw game according to conventional rules of play. Like rewarding the player for winning or taking the wagers away if the player lose.

Through the above methods, the present invention does provide a new method of playing Five-Card Draw by giving players a more exciting experience than traditional Five-Card Draw, and because of the use of special designed playing cards, the way of playing is also more exciting and diversified, so that players will not be easily bored, but stimulated by excitement.

Figure 7:
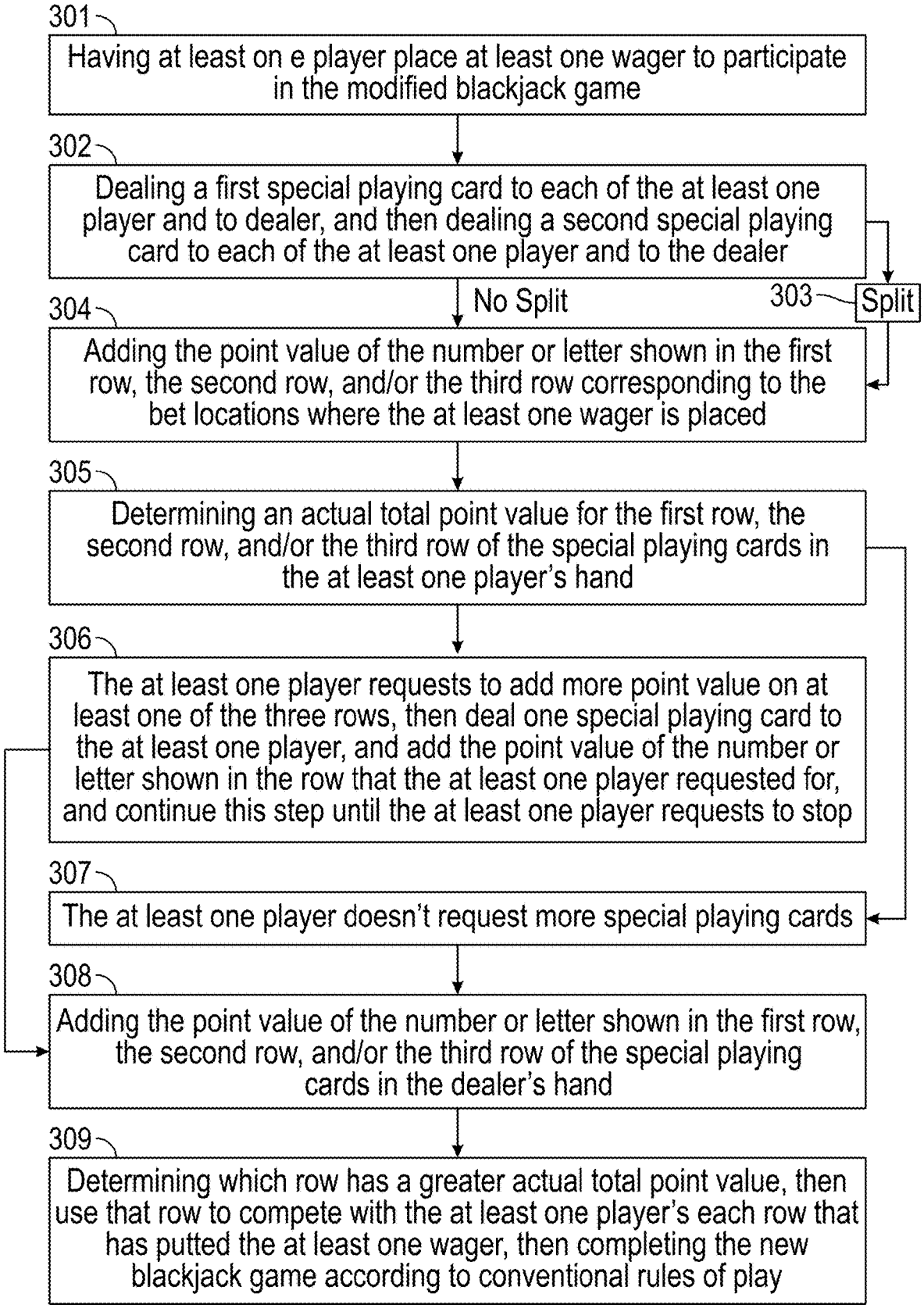
FIG. 7 illustrates the steps of playing method in the second embodiment, in accordance with an embodiment of the present invention.

In another embodiment, this invention discloses another method for playing a new Five-Card Draw game between at least one player and a dealer using at least one deck of special designed playing cards on the Triple Poker card table, like illustrating in the FIG. 7, wherein each of the special designed playing cards contains a first row 602*a*, a second row 602*b*, and a third row 602*c* vertically arranged from the top to the bottom on the surface of the special designed playing card, and the first row 602*a* contains three same numbers or letters with the same suit, the second row 602*b* contains three same numbers or letters with the same suit, the third row 602*c* contains three same numbers or letters with the same suit, and the numbers or letters between each row are different, the method comprising the steps listed below.

Step S301: Having at least one player place at least one wager to participate in the new Five-Card Draw game, wherein the at least one wager can be put on any one or two or all three of the first bet location, the second bet location, and the third bet location.

Step S302: Dealing five special designed playing cards to each of the at least one player facing up in a clockwise manner, and dealing five special designed playing cards to a dealer with two first special designed playing cards facing up, and three second special designed playing cards facing down.

Furthermore, in this step, if the numbers or letters in any row of the two first special designed playing cards in the at least one player's hand are the same, the at least one player can decide whether to split. If the at least one player decide to split, go to step 303, and if the at least one player decide not to split, directly go to step 304.

Within this step in a preferable embodiment, if the numbers or letters in the multiple rows of one of the two first special designed playing cards and the numbers or letters in the corresponding rows of another one of the two first special designed playing cards in the at least one player's hand are the same, the at least one player can decide whether or not split, and how many rows he/she decides to split. Accordingly, in the event that the player wants to split, he/she will place wager on the split location(s). As mentioned before, a split brings a wagering opportunity, which means during a single hand in Triple Poker (new Five-Card Draw) in this embodiment, player(s) will possess up to 6 opportunities to wager at maximum. Alternatively, player(s) may decide to not split to give up the extra wagering opportunities.

Take FIG. 5B as an example, where a player (not dealer) has two row having same numbers ([9] in the first row and [K] in the third row) in the two first original designed playing cards. The player may choose split based on those rows, then put the same amount of wagers as in the bet location (the first bet location to the corresponding (parallel) split location (the first split location), and then the dealer deals eight additional special designed playing cards to the at least one player to make the two first special designed playing cards form a five-card hand respectively after split. Thus, combined with after-split choice, the player has maximum two more bet opportunities based on the split. Therefore, combined all the possibility of the cards and the player's choice, there is a chance to add up to 6 bet opportunities to wager during a single hand in Triple Poker game of the present invention, no doubt increasing the amusement and unpredictability.

Step S303: After the at least one player decides to split the two first special designed playing cards and put at least one wager to the first split location, the second split location, and/or the third split location based on the at least one player's decision, then the dealer will deal eight additional special designed playing cards to the at least one player to make the two first special designed playing cards form a five-card hand respectively after split.

Step S304: Waiting for each of the at least one player to decide whether to place another wager or fold on any of the first bet location, the second bet location, the third bet location, the first split location, the second split location, and/or the third split location, then continue based on the sub-steps listed below:

a) if the at least one player decides to fold on any of the first bet location, the second bet location, the third bet location, the first split location, the second split location, and/or the third split location, the dealer takes the wager placed on the corresponding bet location and/or the corresponding split location, and move to next step;

b) if the at least one player decides to fold on all of the first bet location, the second bet location, the third bet location, the first split location, the second split location, and the third split location the dealer takes the wager placed on the corresponding bet locations and the corresponding split locations, and the game is over; or c) if the at least one player decides to place another wager on any of the first bet location, the second bet location, the third bet location, the first split location, the second split location, and/or the third split location, the game moves to next step. If the at least one player decides not to put any additional wager and pass, the game will also move to next step.

In sub-step (a) and (b), the at least one player can only fold on the row that has wager on the corresponding bet location or split location. If no wager on that bet location or split location, there is no need to fold on the corresponding row. Similar rule will apply to the sub-step (c), the at least one player can only place additional wager on the bet location and/or the split location that has already had wager on. If no wager on a bet location or split location when the game begins, the at least one player cannot add wager to that bet location or split location.

Step S305: Dealing one community cards using the special designed playing cards facing up in the community card slots.

Step S306: Repeating step S304 and the corresponding sub-steps. In this step, the dealer will wait for all player to decide their move.

Step S307: Dealing one more community card using the special designed playing cards facing up in the remaining community card slots.

Step S308: Repeating step S304 and the corresponding sub-steps again. In this step, the dealer will wait for all player to decide their move again.

Step S309: Dealing a last community card using the special designed playing cards facing up in the last remaining community card slots.

Step S310: Repeating step S304 and the corresponding sub-steps one last time. In this step, the dealer will wait for all player to decide their move.

Step S311: Revealing the three second special designed playing cards in the dealer's hand, and determining which row combining the community cards could form a best possible hand and use that row to compete with the at least one player's best possible hand for each row that has put the at least one wager. In this step, if the at least one player splits in the step 303, the dealer also need to compete with the at least one player's best possible hand for each row in the at least one player's spilt hand that has put the at least one wager on.

Step S312: Completing the new Five-Card Draw game according to conventional rules of play. Like rewarding the player for winning or taking the wagers away if the player loses.

Through the above methods, compared with the previous embodiment, this embodiment adds a split game method (split opportunities 1~3) on the original basis. Although this also appears in general Five-Card Draw game, when playing with special designed playing cards, it will make split more interesting while in game and can also show that the present invention does provide a new Five-Card Draw game, which allowing players to get a more exciting experience than traditional Five-Card Draw, and because of the use of special designed playing cards, the way of playing is also more diversified, so that players will not easily get bored, but stimulated with excitement that Triple Poker offers.

In the abovementioned two different embodiments, the first row 602*a*, the second row 602*b*, or the third row 602*c* on at least one of the special designed playing cards contains letters of "WILD" 603, and "WILD" 603 represent any number, letter, and suit that a player or a dealer could build for the best possible hand. Just like the example mentioned above, these special designed playing cards allow each player to have additional interesting feature by using "WILD" to make the game much more unpredictable. For example, the "WILD" 603 in the second row 602*b* of the second community card will make the Dealer's hand has a "Q pair", while also making the player's hand has "9-K Straight" (original hand) and also "9-K Straight" (split hand), and therefore, allowing the player to win in the second row 602*c* (only the first row of the player's split hand was losing). Thus, it will make the player enjoy the game more.

In summary, the present invention does provide a new & unique card table to allow players to play the special designed playing cards and the Triple Poker games, and the present invention has the following advantages:

A. Allowing players to bet up to six hands at once.

B. Allow each player to play up to six hands at once.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

I claim:

1. A Triple Poker card table, with which players use at least one deck of special designed playing cards to play a new Five-Card Draw game and bet up to 3~6 bets at a time, wherein each of the special designed playing cards contains a first row, a second row, and a third row vertically arranged from top to bottom on a surface of the special designed playing cards, and the first row contains three of the same number or letter with the same suit, the second row contains three of the same number or letter with the same suit, the third row contains three of the same number or letter with the same suit, and the numbers or letters between each row are different, the Triple Poker card table comprising:

a table structure, with a surface that has a plurality of player areas and three community card slots, and each player area is provided with a first bet location, a second bet location, and a third bet location, these bet locations are arranged vertically, and the first bet location corresponds to the first row on the surface of the special designed playing cards, the second bet location corresponds to the second row on the surface of the special designed playing cards, and the third bet location corresponds to the third row on the surface of the special designed playing cards, and there are a first split location, a second split location, and a third split location that are adjacent to the first bet location, the second bet location, and the third bet location respectively; and two table legs, which are set under the table structure.

2. The Triple Poker card table of claim 1, wherein a bottom surface of the table structure is provided with two holes, and one end of each of the table legs is correspondingly provided with a convex part, so that each convex part is inserted into a corresponding one of the two holes to fix the table legs to the table structure.

3. The Triple Poker card table of claim 2, wherein the depth of the holes is 3 and ⅛ inch, and the distance between the holes and a nearest end cap is also 3 and ⅛ inch.

4. The Triple Poker card table of claim 3, wherein the bottom surface of the table structure is provided with a convex column, and the convex column is horizontally arranged at the middle section of the bottom surface of the table structure, and the holes are arranged on the convex column.

5. The Triple Poker card table of claim 1, wherein the first row, the second row, or the third row on at least one of the special designed playing cards contains letters of "WILD", and "WILD" represents any number or letter and suit combination that a player or a dealer chooses in order to build the best possible hand.

6. The Triple Poker card table of claim 5, wherein the suit of the first row, the second row, and the third row are all different.

7. A method for playing a new Five-Card Draw game between at least one player and a dealer using at least one deck of the special designed playing cards of claim 1 on the Triple Poker card table of claim 1, the method comprising steps of:

A) having at least one player place at least one wager to participate in the new Five-Card Draw game, wherein the at least one wager can be put on any one or two or all three of the first bet location, the second bet location, and the third bet location;

B) dealing five special designed playing cards to each of the at least one player facing up in a clockwise manner;

C) dealing five special designed playing cards to the dealer with two first special designed playing cards facing up, and three second special designed playing cards facing down;

D) waiting for each of the at least one player to decide whether to place another wager or fold on any one or two or all three of the first bet location, the second bet location, and the third bet location, then;

a) if the at least one player decides to fold on any one or two of the first bet location, the second bet location, and the third bet location, the dealer takes the wager placed on the corresponding bet location, and moves to next step;

b) if the at least one player decides to fold on all three of the first bet location, the second bet location, and the third bet location, the dealer takes the wager placed on the corresponding bet locations, and the game is over; or c) if the at least one player decides to place another wager on any one or two or all three of the first bet location, the second bet location, and the third bet location, the game moves to next step;

E) dealing one community card using the special designed playing cards facing up in a first of the three community card slots;

F) repeating step (D) and corresponding sub-steps;

G) dealing one more community card using the special designed playing cards facing up in one of the remaining community card slots;

H) repeating step (D) and the corresponding sub-steps;

I) dealing a last community card using the special designed playing cards facing up in a last remaining community card slot;

J) repeating step (D) and the corresponding sub-steps;

K) revealing the second special designed playing cards in the dealer's hand, and determining which row combining the community cards forms a best possible hand and use that row to compete with the at least one player's best possible hand for each row that has put the at least one wager on the corresponding bet location; and L) completing the new Five-Card Draw game according to conventional rules of play.

8. The method of claim 7, wherein the first row, the second row, or the third row on at least one of the special designed playing cards contains letters of "WILD", and "WILD" represents any number or letter and suit combination that the at least one player or the dealer chooses in order to build the best possible hand.

9. The method of claim 8, wherein the suit of the first row, the second row, and the third row are all different.

10. A method for playing a new Five-Card Draw game between at least one player and a dealer using at least one deck of the special designed playing cards of claim 1 on the Triple Poker card table of claim 1, the method comprising steps of A) having at least one player place at least one wager to participate in the new Five-Card Draw game, wherein the at least one wager can be put on any one or two or all three of the first bet location, the second bet location, and the third bet location;

B) dealing five special designed playing cards to each of the at least one player facing up in a clockwise manner;

C) dealing five special designed playing cards to the dealer with two first special designed playing cards facing up, and three second special designed playing cards facing down, then;

i) if the numbers or letters in any row of the two first special designed playing cards dealt to the at least one player's hand are the same, the at least one player can split the first two special designed playing cards and put at least one wager in the first split location, the second split location, and/or the third split location based on the at least one player's decision, then deal eight additional special designed playing cards to the at least one player to make the two first special designed playing cards form a five-card hand respectively after split;

D) waiting for each of the at least one player to decide whether to place another wager or fold on any of the first bet location, the second bet location, the third bet location, the first split location, the second split location, and/or the third split location, then;

a) if the at least one player decides to fold on any of the first bet location, the second bet location, the third bet location, the first split location, the second split location, and/or the third split location, the dealer takes the wager placed on the corresponding bet location and/or the corresponding split location, and moves to next step;

b) if the at least one player decides to fold on all of the first bet location, the second bet location, the third bet location, the first split location, the second split location, and the third split location, the dealer takes all the wager placed on the corresponding bet locations and the corresponding split location, and the game is over; or c) if the at least one player decides to place another wager on any of the first bet location, the second bet location, the third bet location, the first split location, the second split location, and/or the third split location, the game moves to next step;

E) dealing one community card using the special designed playing cards facing up in the community card slots;

F) repeating step (D) and corresponding sub-steps;

G) dealing one more community card using the special designed playing cards facing up in the remaining community card slots;

H) repeating step (D) and the corresponding sub-steps;

I) dealing a last community card using the special designed playing cards facing up in a last remaining community card slots;

J) repeating step (D) and the corresponding sub-steps;

K) revealing the second special designed playing cards in the dealer's hand, and determining which row combining the community cards forms a best possible hand and use that row to compete with the at least one player's best possible hand for each row that has put the at least one wager on the corresponding bet location; and L) completing the new Five-Card Draw game according to conventional rules of play.

11. The method of claim 10, wherein the first row, the second row, or the third row on at least one of the special designed playing cards contains letters of "WILD", and "WILD" represents any number or letter and suit combination that the at least one player or the dealer chooses in order to build the best possible hand.

12. The method of claim 11, wherein the suit of the first row, the second row, and the third row are all different.

* * * * *